US012426766B2

(12) United States Patent
Alwardt

(10) Patent No.: US 12,426,766 B2
(45) Date of Patent: Sep. 30, 2025

(54) UPRIGHT MOP HOLDER

(71) Applicant: Keith Alwardt, Hartford, WI (US)

(72) Inventor: Keith Alwardt, Hartford, WI (US)

(73) Assignee: Keith Alwardt, Hartford, WI (US)

( * ) Notice: Subject to any disclaimer, the term of this patent is extended or adjusted under 35 U.S.C. 154(b) by 316 days.

(21) Appl. No.: 17/706,290

(22) Filed: Mar. 28, 2022

(65) Prior Publication Data

US 2023/0032482 A1 Feb. 2, 2023

Related U.S. Application Data

(60) Provisional application No. 63/228,357, filed on Aug. 2, 2021.

(51) Int. Cl.
*A47L 13/51* (2006.01)

(52) U.S. Cl.
CPC ..... *A47L 13/51* (2013.01)

(58) Field of Classification Search
CPC ..... A47L 13/51; A47L 13/512; A47L 13/58
USPC ..... 248/113; 15/228
See application file for complete search history.

(56) References Cited

U.S. PATENT DOCUMENTS

| | | | | | |
|---|---|---|---|---|---|
| 204,215 | A * | 5/1878 | Haas | A47L 13/58 | 15/263 |
| 297,040 | A * | 4/1884 | Walter | A47L 13/58 | 15/263 |
| 736,831 | A * | 8/1903 | Eidt | A47L 13/512 | 248/113 |
| 810,640 | A * | 1/1906 | Greener | B44D 3/123 | 248/113 |
| 4,121,798 | A * | 10/1978 | Schumacher | B44D 3/123 | 24/336 |
| 2015/0190030 | A1* | 7/2015 | Johnson | A47L 13/59 | 15/264 |
| 2017/0023176 | A1* | 1/2017 | Goetsch | F16B 45/036 | |

* cited by examiner

*Primary Examiner* — Tom Rodgers
(74) *Attorney, Agent, or Firm* — Jordan E. Meggison-Decker; BrownWinick Law Firm

(57) ABSTRACT

A system and method for an improved mop holder which accommodates a variety of mop types and sizes is disclosed. The improved mop holder is inexpensive to manufacture, simple to use, and is adaptable to a variety of buckets having different sizes and shapes. The mop holder secures the mop handle in a substantially upright vertical position. A user can implement the mop holder by attaching a groove in the mop holder body to a bucket lip. Further, the user can secure the mop holder body to the bucket using a fastener. A user can insert a mop handle through a spring loaded lever into the cavity. Once inserted, the mop handle can be retained by the lever in an upright position.

4 Claims, 5 Drawing Sheets

UPRIGHT MOP HOLDER

CROSS-REFERENCE TO RELATED APPLICATIONS

This is a Nonprovisional Utility U.S. Patent Application filed under 37 CFR 1.53(b). This application claims the benefit and priority of U.S. Provisional Application No. 63/228,357, filed Aug. 2, 2021, the content of which is incorporated herein by reference.

BACKGROUND OF THE INVENTION

1. Field of the Invention

The present disclosure relates generally to attachments for cleaning buckets and more specifically to holders for mop handles.

2. Description of Related Art

An unsecured wet mop can create potential hazards in the cleaning business and at home. A mop that is unsecured from within a bucket can slide and fall out of a bucket. The mop and the water it is holding can become a physical hazard to a worker who can fall due to the mop or water on the floor. A falling mop handle can scuff a floor or wall. A mop handle on the floor of a business can be a physical hazard to other workers, customers, etc. A mop handle on the floor of a home can be a hazard to family members or pets. Thus, there is a need in the field of cleaning for a holder that can be attached to a bucket for securing mop handles.

SUMMARY OF THE INVENTION

It is an object of the invention to provide an improved mop holder which accommodates a variety of mop types and sizes. It is another object of the invention to provide a mop holder which is inexpensive to manufacture, simple to use, and is adaptable to a variety of buckets having different sizes and shapes. Another object of the invention is to provide a mop holder which secures the mop handle in a substantially upright vertical position. A user can implement a mop holder by attaching a groove in the mop holder body to a bucket lip. Further, the user can secure the mop holder body to the bucket using a fastener. A user can insert a mop handle through a spring loaded lever into the cavity. Once inserted, the mop handle can be retained by the lever in an upright position.

These and other features and advantages will be apparent from reading of the following detailed description and review of the associated drawings. It is to be understood that both the forgoing general description and the following detailed description are explanatory and do not restrict aspects as claimed.

DETAILED DESCRIPTION OF EMBODIMENTS

The following descriptions relate principally to preferred embodiments while a few alternative embodiments may also be referenced on occasion, although it should be understood that many other alternative embodiments would also fall within the scope of the invention. The embodiments disclosed are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, conceptually encompassing equivalents, unless and only to the extent that a particular context clearly requires otherwise.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. Furthermore, unless explicitly dictated by the language, the term "and" may be interpreted as "or" in some instances. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more. Thus, in the context of this specification, the term "comprising" is used in an inclusive sense and thus should be understood as meaning "including, but not limited to." As used herein, the use of "may" or "may be" indicates that a modified term is appropriate, capable, or suitable for an indicated capacity, function, or usage, while considering that in some circumstances the modified term may sometimes not be appropriate, capable, or suitable. "Plurality" is defined as more than one when used to describe a quantity in the specification and claims. Any "examples" of embodiments and components (e.g. dimensions) described herein are considered non-limiting examples.

Figure 1:
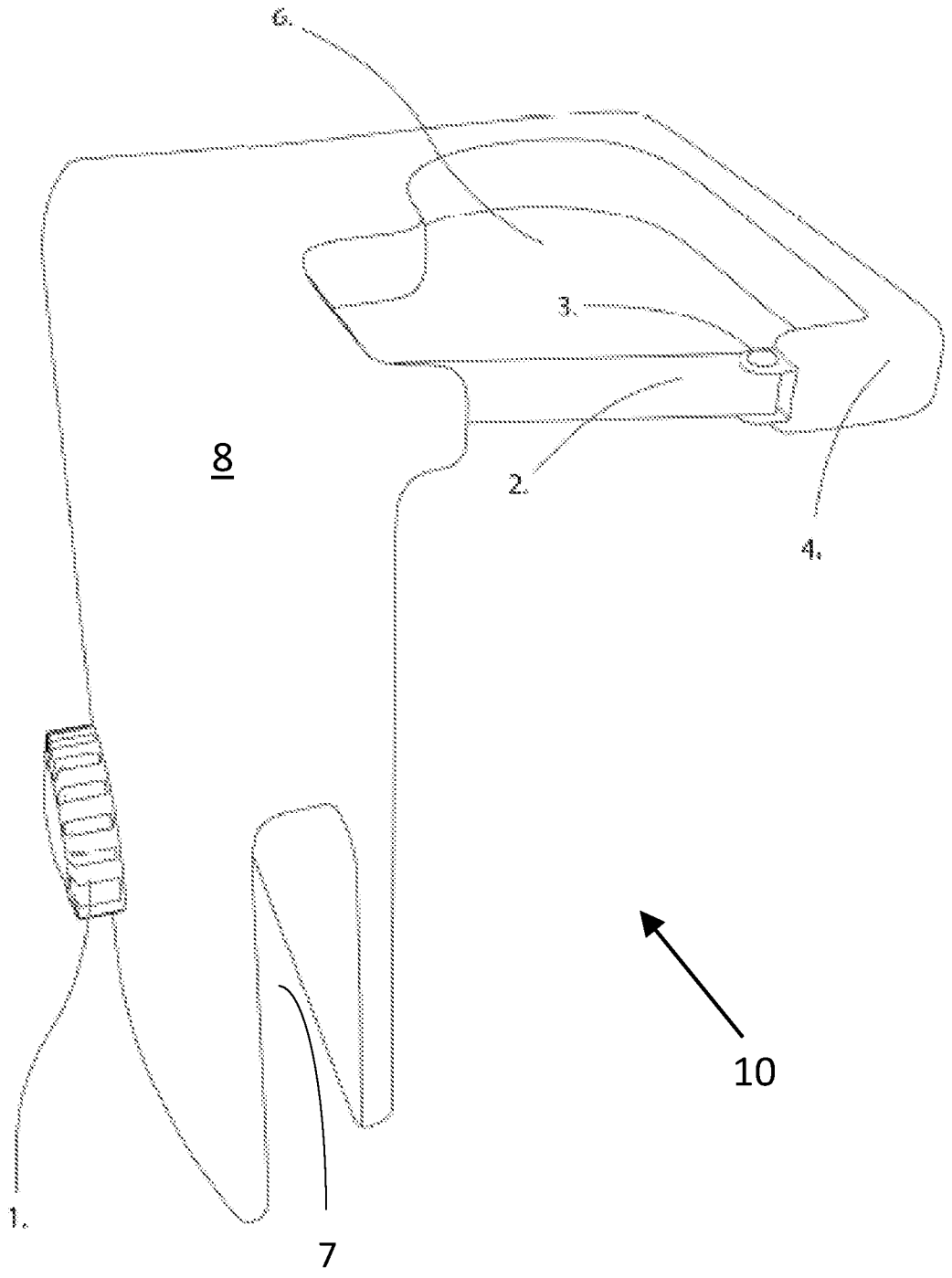
FIG. 1 illustrates a perspective view of an example mop holder embodiment.

FIG. 1 illustrates a perspective view of an example mop holder embodiment 10. The mop holder 10 includes a mop holder body 8 constructed of a suitable material such as a solid plastic or other man-made synthetic material. For example, the material can be a high density plastic such as high density polyethylene (HDPE). An alternative embodiment of materials can include metal, wood, or a composite material. The mop holder includes a groove opening 7 in the mop holder body 8, wherein the groove opening 7 is configured to attach over a lip of a bucket (see FIG. 4). The groove opening 7 has inner walls and the bottom of the holder body 8 preferably has curved edges. The holder body 8 includes a cavity 6 at the top for holding a handle of a mop. Further, the mop holder 10 includes a lever 2 operatively connected to the holder body 8. The lever 2 includes a spring 3 and functions as a spring loaded lever 2. The spring loaded lever 2 is configured to retain a mop handle in the cavity of the holder body 8.

The mop holder 10 can include a fastener 1 for securing the mop holder 10 to a bucket. A fastener 1 is not required since the mop holder 10 attaches to a bucket lip using a groove opening 7 and provides some stability. A fastener 1 can provide additional security, especially when the holder body 8 loosely fits over a bucket lip with spacing between the inner walls of the groove 7 and the bucket lip. As shown, the fastener 1 can include a rotatable knob although other types of fasteners can be implemented.

Figure 2:
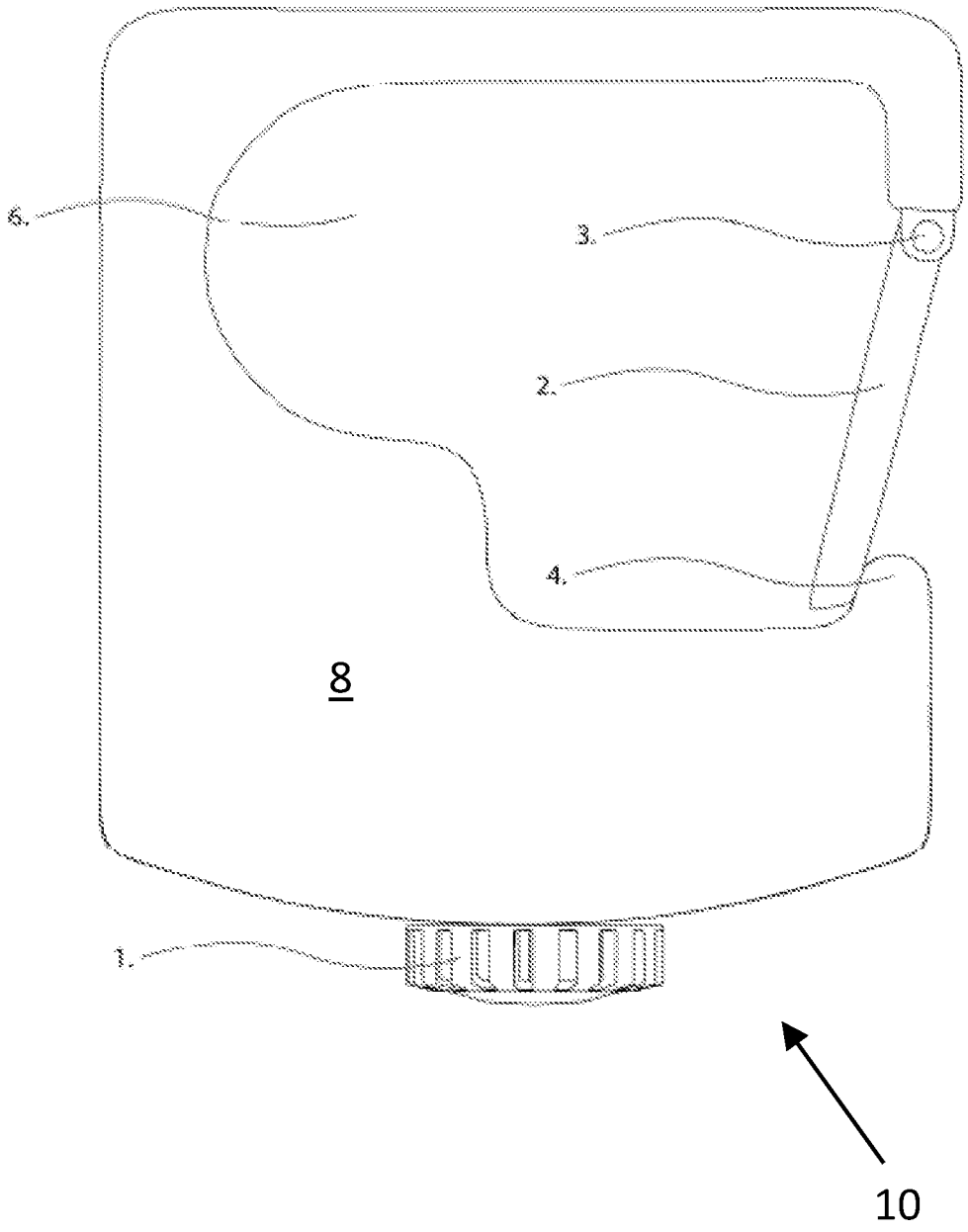
FIG. 2 illustrates a top view of an example mop holder embodiment.

FIG. 2 illustrates a top view of an example mop holder embodiment 10. The lever 2 includes a spring 3 and can be opened by pushing the lever 2 into the cavity 6. To open the lever 2, a user can manually push the lever 2 inward or the user can push a mop handle into the lever 2 toward the cavity 6. The mop holder body 8 can further include a guide 4 to retain the lever 2 in the cavity 6. The guide 4 is a protruded section of the holder body 8 that prevents the lever 2 from moving outward away from the cavity 6. Once a mop handle is inserted through the lever 2 into the cavity 6, the handle cannot escape unless the lever 2 is manually held open.

Figure 3:
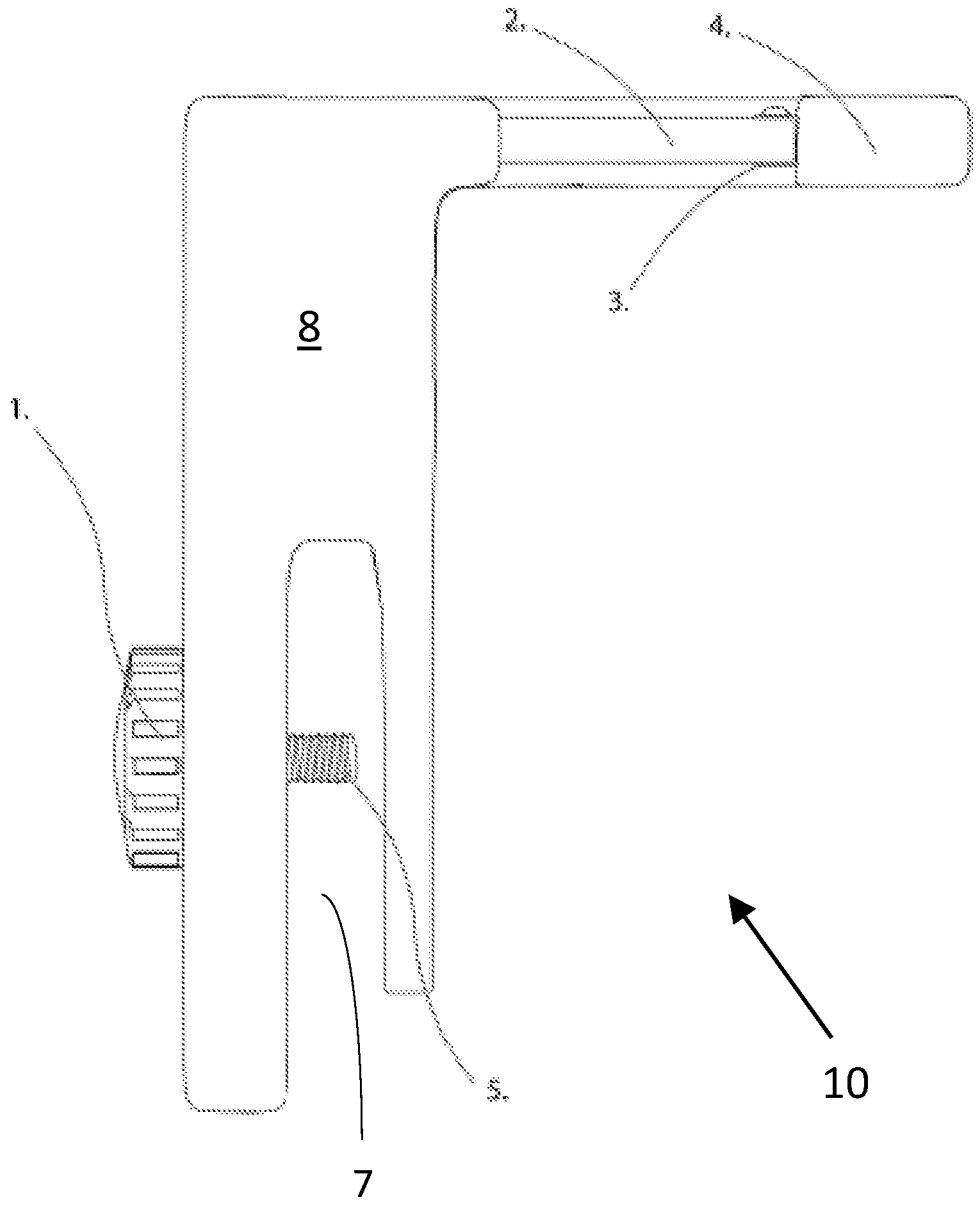
FIG. 3 illustrates a side view of an example mop holder embodiment.
Figure 4:
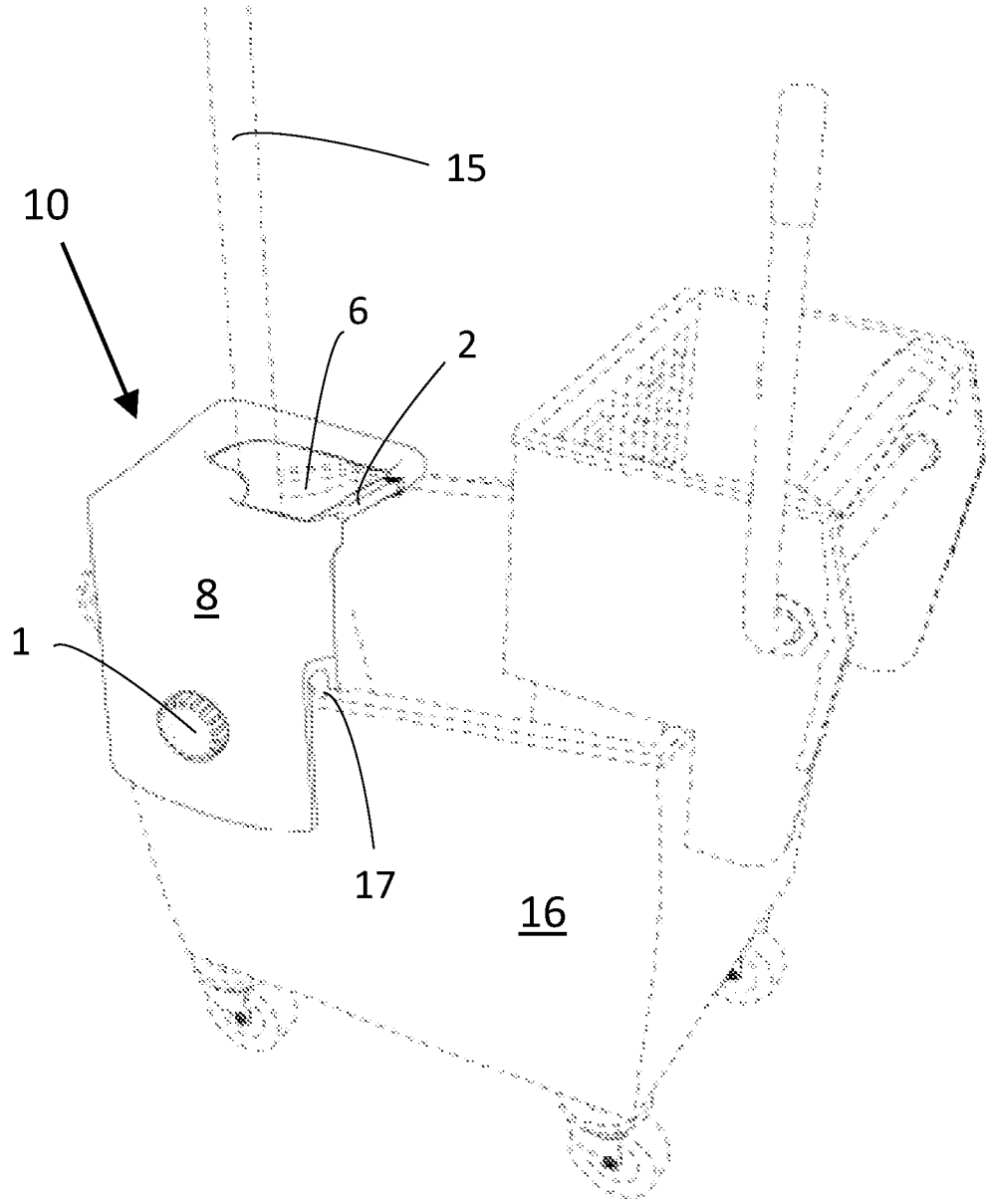
FIG. 4 illustrates a perspective view of an example mop holder embodiment implemented in a commercial mop bucket.
Figure 5:
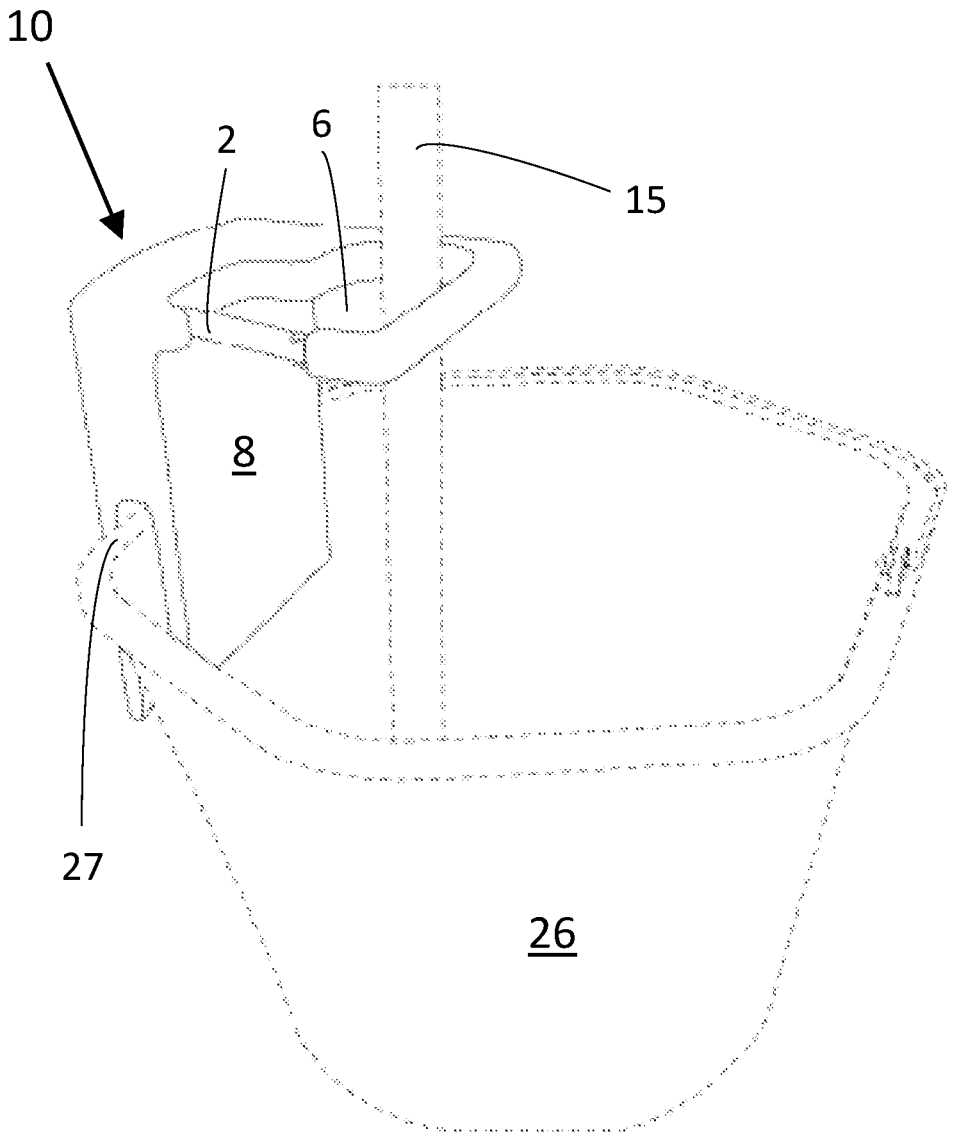
FIG. 5 illustrates a perspective view of an example mop holder embodiment implemented in a home mop bucket.

FIG. 3 illustrates a side view of an example mop holder embodiment 10. In this example, the fastener 1 includes a knob operatively connected to a threaded fastener (e.g. bolt) 5. The bolt 5 passes through a hole in the holder body 8. A user can rotate the knob 1 which forces the bolt 5 into the groove opening 7. With reference to FIGS. 4 and 5, the bolt 5 can secure the holder body 8 to the bucket by applying pressure to the bucket lip.

FIG. 4 illustrates a perspective view of an example mop holder embodiment 10 implemented in a commercial mop bucket 16. The mop holder 10 can be used on almost any size bucket, including commercial and home buckets. A user can implement the mop holder 10 by attaching the groove opening 7 to a lip 17 of a bucket 16. Further, the user can secure the mop holder body 8 to the bucket 16 using a fastener 1. For example, a fastener 1 can include a bolt 5 to secure the holder body 8 to the bucket 16 by applying pressure to the bucket lip 17. A user can insert a mop handle 15 through the lever 2 into the cavity 6. Once inserted, the mop handle 15 can be retained by the lever 2 in a substantially vertical upright position.

FIG. 5 illustrates a perspective view of an example mop holder embodiment 10 implemented in a bucket 26. The bucket 26 can be various sizes and in this example, the mop bucket 26 shown is typically used in a residential home. The enclosed area of the cavity 6 is large enough for mop handles 15 of various diameters. For example, the cavity 6 can be sized to hold mop handles 15 with less than a half inch diameter, a half inch diameter, greater than a half inch diameter, etc.

The invention claimed is:

1. A mop holder for a bucket, the mop holder comprising:
a mop holder body comprising a top end and opposing a bottom end and a first side opposing a second side;
a groove opening in the mop holder body;
the groove opening comprising a lower end at the bottom end of the mop holder body and an upper end disposed above the lower end of the groove opening within the mop holder body and a portion of the mop holder body disposed between the upper end of the groove opening and the top end of the mop holder body extends above the bucket;
the lower end comprising at least a first lower end and a second lower end separated by the groove opening, each of the first lower end and the second lower end having an interior wall and an exterior wall;
a fastener for securing the mop holder to the bucket, wherein the fastener is located in either the first lower end or the second lower end;
the upper end comprising a curved surface connecting the first lower end to the second lower end;
the curved surface configured to sit on top of a lip of the bucket;
the groove opening is configured to secure the mop holder over the lip of the bucket, wherein the interior wall of the first lower end and the interior wall of the second lower end are adjacent to a wall of the bucket;
the top end having a first wall, a second wall, a third wall, and a fourth wall;
a cavity in the top end of the mop holder body, the cavity enclosed by the first wall, the second wall, the third wall and the fourth wall;
a spring loaded lever comprising at least a portion of one of the first wall, second wall, third wall, and fourth wall;
the spring loaded lever is operatively connected to the top end of the mop holder body adjacent to the cavity,
the spring loaded lever opens inwardly into the cavity by pressing a mop handle against the lever and into the cavity,
the spring loaded lever closes by operation of the spring when the mop handle clears the lever; and
wherein the lever is configured to retain the mop handle in the cavity of the mop holder body such that the mop handle is retained in a generally vertical position.

2. The mop holder of claim 1, wherein the fastener includes a knob operatively connected to a bolt.

3. The mop holder of claim 1, wherein the mop holder further comprises a guide to retain the lever in the cavity.

4. A mop holder system for a bucket, the mop holder comprising:
a mop bucket assembly having a bucket and a wringer; and
the bucket having a top end with a lip;
a mop holder body comprising a top end and a bottom end;
a groove opening in the mop holder body, wherein the groove opening comprises a lower end at the bottom end of the mop holder body and an upper end disposed above the lower end of the groove opening within the mop holder body, wherein the groove opening is configured to attach over a lip of the bucket, and wherein a portion of the mop holder body disposed between the upper end of the groove opening and the top end of the mop holder body extends above the bucket;
a fastener for securing the mop holder to the bucket, wherein the fastener traverses the groove opening;
the top end having a first wall, a second wall, a third wall, and a fourth wall;
a cavity in the top end of the mop holder body, the cavity enclosed by the first wall, the second wall, the third wall and the fourth wall;
a lever including a spring;
the lever is operatively connected to the top end of the mop holder body adjacent to the cavity, the lever comprising at least a portion of one of the first wall, second wall, third wall, and fourth wall;

wherein the lever is operatively connected to the top end of the mop holder body adjacent to the cavity, the lever opens inwardly into the cavity by pressing a mop handle against the lever and into the cavity, and the lever closes by operation of the spring when the mop handle clears the lever; and wherein the lever is configured to retain the mop handle in the cavity of the mop holder body such that the mop handle is retained in a generally vertical position.

* * * * *